United States Patent [19]

Vorreiter

[11] 4,184,609

[45] Jan. 22, 1980

[54] CRYOGENIC CONTAINER COMPOUND SUSPENSION STRAP

[75] Inventor: John W. Vorreiter, Sunnyvale, Calif.

[73] Assignee: The United States of America as represented by the Administrator of the National Aeronautics and Space Administration, Washington, D.C.

[21] Appl. No.: 935,827

[22] Filed: Aug. 22, 1978

[51] Int. Cl.[2] ..... B65D 25/18

[52] U.S. Cl. ..... 220/445; 220/423; 220/901

[58] Field of Search ..... 220/445, 448, 437, 439, 220/420, 425, 901, 421, 423

[56] References Cited

U.S. PATENT DOCUMENTS

| | | | |
|---|---|---|---|
| 1,866,517 | 7/1932 | Heylandt | 220/901 X |
| 2,592,974 | 4/1952 | Sulfrian | 220/901 X |
| 2,722,336 | 11/1955 | Wexler et al. | 220/445 X |
| 2,814,410 | 11/1957 | Hansen | 220/445 |
| 2,823,822 | 2/1958 | Altman | 220/425 |
| 2,864,527 | 12/1958 | Altman et al. | 220/445 X |
| 2,926,810 | 3/1960 | Yeager | 220/421 X |
| 3,021,027 | 2/1962 | Claxton | 220/437 |
| 3,115,983 | 12/1963 | Wissmiller | 220/437 |
| 3,274,788 | 9/1966 | Hoffman et al. | 220/423 X |
| 3,764,036 | 10/1973 | Dale et al. | 220/901 X |

*Primary Examiner*—Allan N. Shoap

*Attorney, Agent, or Firm*—Darrell G. Brekke; John R. Manning; Armand McMillan

[57] ABSTRACT

The present invention is directed to a support structure formed from a compound strap consisting of two or more links of different thicknesses. More particularly, the compound strap includes a thinner link which is connected to the cool end of the inner storage tank's outer wall and a thicker link which is connected to the warmer outer wall of a relatively larger outer tank which encloses the inner tank to provide a vacuum space. This vacuum space around the inner tank contains the thermal support straps preferably made of fiberglass epoxy resin material used to support the inner tank from the inner wall of the outer tank. The compound strap of the present invention minimizes the heat leak between the inner tank and the outer tank.

3 Claims, 2 Drawing Figures

CRYOGENIC CONTAINER COMPOUND SUSPENSION STRAP

GOVERNMENT RIGHTS

The invention described herein was made by an employee of the United States Government, and may be manufactured and used by or for the government for governmental purposes without payment of any royalties thereon or therefor.

BACKGROUND OF THE INVENTION

1. Field of the Invention

The present invention is directed to a cryogenic storage vessel wherein the inner storage tank is suspended from the outer storage tank by means of a compound strap.

2. Description of the Prior Art

Many exemplary straps for suspending an inner tank from an outer tank are illustrated in the prior art. For example, the patent issued to Heylandt, U.S. Pat. No. 1,866,517, discloses a double wall storage container having suspension chains with sections of low thermal leakage to support the inner container shell. The patent issued to Wexler et al, U.S. Pat. No. 2,722,336, discloses a spaced wall arrangement to store liquefied gases wherein one smaller inside container is supported and spaced within a larger outer container by a plurality of spacers having heat insulation properties for thermally insulating the liquefied gas stored within the inside container.

The patents issued to Berner et al, U.S. Pat. No. 3,230,726, and Hoffman et al, U.S. Pat. No. 3,274,788, disclose double-walled thermally-insulated containers wherein the inner product container is supported relative to the outer insulating container by means of a low thermal conductivity material to minimize heat leakage.

The Bridges patent, U.S. Pat. No. 3,623,626, discloses a system for supporting product tanks housed within the hold of a ship. The supporting elements comprise arms or links connected to the product tank and to the structure of the ship which vary in accordance with a predetermined straight-line contraction and expansion of the tank.

In addition to the prior art discussed above, several other methods have been used to support the inner shell of a cryogenic storage vessel from the inner surface of the outer shell. These methods used highly porous low conductivity material such as woven fiberglass or balsa wood to support the inner shell.

The support means for connecting an inner container to an outer container disclosed in the prior art suffers from disadvantages which are solved by the compound strap of the present invention. The present invention sets forth a novel combination of a compound strap consisting of two or more links of different thicknesses. More particularly, the compound strap of the present invention is used in a cryogenic storage vessel to support an inner storage tank from an outer storage tank. The compound strap of the present invention is preferably made of a fiberglass epoxy resin material which is designed to minimize heat leakage from the outer storage tank to the inner storage tank.

SUMMARY OF THE INVENTION

It is an object of the present invention to provide a compound strap which is used in a cryogenic storage vessel to support an inner storage tank from an outer storage tank.

Another object of the present invention is to provide a compound strap which consists of two or more links of different thicknesses.

A further object of the present invention is to provide a compound strap which minimizes the heat leakage from the outer storage tank to the inner storage tank and therefore reduces the boil-off rate.

A still further object of the present invention is to provide a compound strap which is preferably made of a fiberglass epoxy resin material and wherein the thin strap link is connected to the inner storage tank and the thicker strap link is connected to the spaced inner wall of the outer storage tank.

A still further object of the present invention is to provide a compound strap which minimizes heat loss because of the graduated thickness of the compound strap from the inner storage tank to the outer storage tank.

These and other objects of the present invention are accomplished by constructing a compound strap preferably of a fiberglass epoxy resin material which includes a thinner link connected to the inner cool storage tank and a thicker link connected to the outer warmer storage tank. A thinner inner link of the compound strap may be used in a cryogenic storage vessel because of the superior structure characteristics of the strap material at cryogenic temperatures.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Cryogenic storage vessels store liquefied gases at very cold temperatures in the range of approximately minus 100° C. to minus 273° C. and at moderate pressures of approximately 1 to 10 atmospheres. The liquid gases stored within the vessels tend to boil away and are vented into the atmosphere in direct proportion to the amount of heat leaking into the vessel. These gases which boil away and are vented into the atmosphere are wasted. Therefore, to minimize the boil off of liquid gases, storage vessels are often constructed of an outer shell and an inner shell with a very high vacuum interposed therebetween. Further, the space between the outer shell and the inner shell is usually specially insulated and has positioned therein a plurality of support members to suspend an inner shell or storage tank from the inner surface of an outer shell or storage tank. The compound strap of the present invention which supports the inner shell from the inside surface of the outer shell is designed to minimize the heat leakage therebetween.

Figure 1:
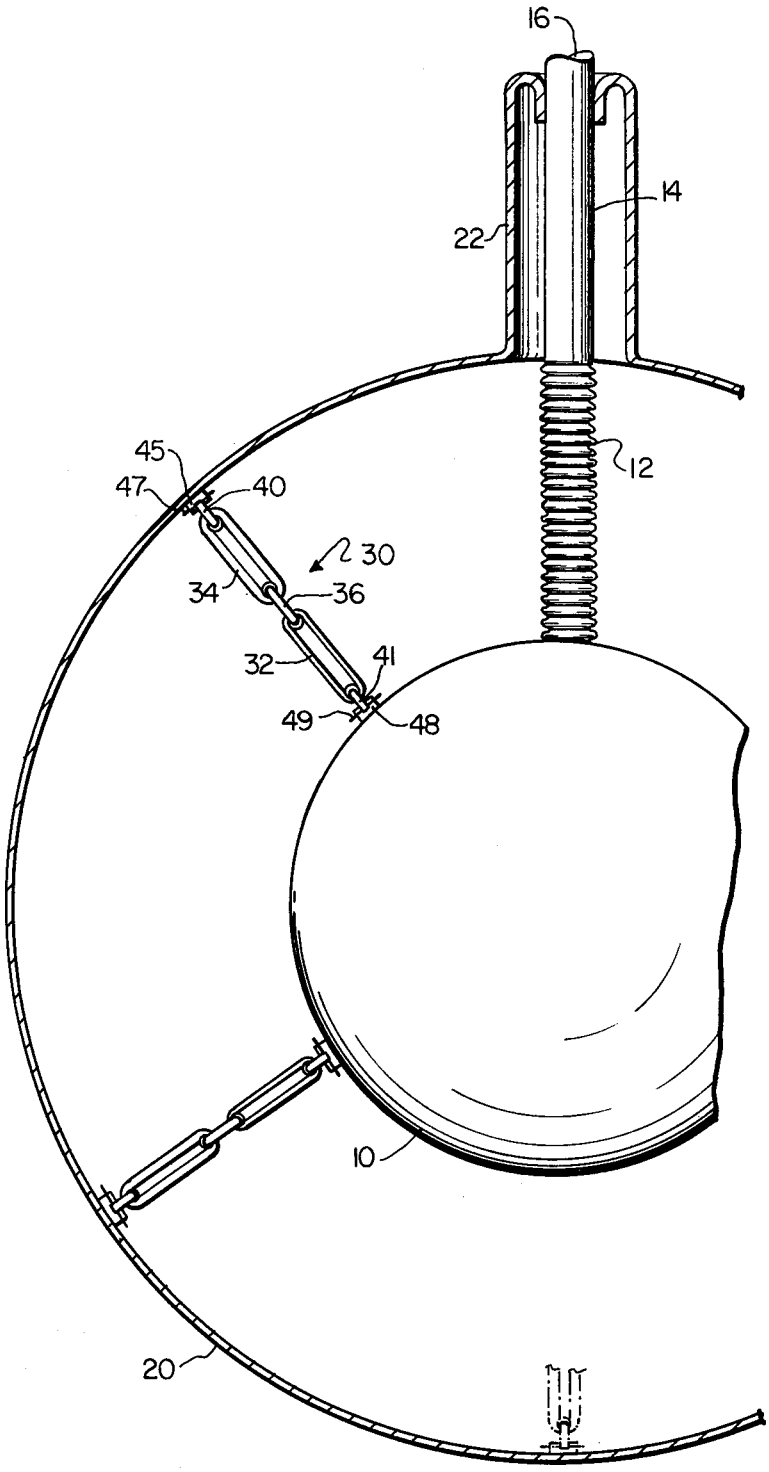
FIG. 1 illustrates a cryogenic storage vessel which includes a plurality of compound straps according to the present invention.

FIG. 1 illustrates a partial cross-sectional view of a cryogenic container which includes an inner storage tank 10 which is suspended from the inner surface of an outer storage tank 20 by means of a plurality of compound straps 30. The space between the inner storage tank 10 and the outer storage tank 20 is highly evacuated to minimize the conduction of heat from the inner storage tank to the outer storage tank. As is conventional, the space between the inner storage tank and the outer storage tank may include a special insulation. Further, to minimize heat loss due to radiation, it is conventional to provide the inner shell or storage tank 10 with a polished reflecting surface.

The inner storage tank 10 includes a tube 14 which projects upwardly through the neck portion 22 of the outer storage tank 20. As illustrated in FIG. 1, the upper portion of the neck 22 is hermetically sealed to the tube 14. The tube 14 includes an inlet and outlet 16 and further includes a bellows portion 12. The bellows portion 12 is designed to deform to accommodate relative movement between the inner storage tank 10 and the outer storage tank 20 due to thermal expansion and contraction.

Figure 2:
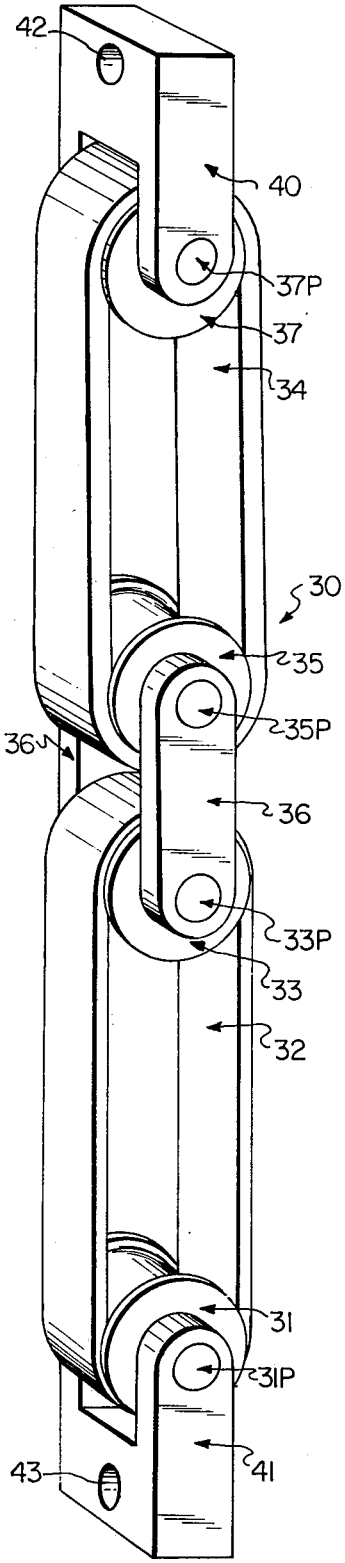
FIG. 2 illustrates an enlarged view of the compound strap of the present invention.

As illustrated in FIGS. 1 and 2, the compound strap 30 includes two links 32 and 34 which are connected together by a link bar 36. Although the drawings illustrate two links which are connected together, it should be understood, that the present invention is not limited to any particular number of links. The size, shape, length, and number of links would be determined by the distance between the inner storage tank 10 and the inner surface of the outer storage tank 20.

The compound strap 30 of the present invention is designed to minimize heat leakage from the outer storage tank 20 to the inner storage tank 10 by reducing the thicknesses of the link members as they progress from the inner surface of the outer storage tank 20 to the inner storage tank 10. As illustrated in FIGS. 1 and 2, the link 32 which is positioned adjacent the inner storage tank 10 is of approximately one-half the thickness of the link 34 which is positioned adjacent the inner surface of the outer storage tank 20. One end of the link 32 is mounted on a spool 31 which is connected to a yoke 41 by means of a connecting pin 31P. The other end of the link 32 is mounted on a spool 33 which is connected to a link bar 36 by means of a connecting pin 33P. Similarly, one end of the link 34 is mounted on a spool 35 which is connected to a link bar 36 by means of a connecting pin 35P. As illustrated in FIG. 2, the link bar 36 extends on both sides of the spools upon which the links 32 and 34 are positioned. Further, the other end of the link 34 is mounted on a spool 37 which is connected to a yoke 40 by means of a connecting pin 37P.

As previously, stated, the compound strap 30 supports the inner storage tank 10 from the inner surface of the outer storage tank 20. It should be understood, that any means of attaching the yoke 40 to the inner surface of the outer storage tank 20 and the yoke 41 to the inner storage tank 10 may be utilized in employing the compound strap of the present invention. One embodiment of a means for connecting the yoke 40 to the inner surface of the outer storage tank 20 would employ the use of a block 45 into which the yoke 40 is adapted for insertion. After the yoke 40 is inserted into the block 45, a pin 47 may be inserted through openings in the block 45 and the opening 42 in the yoke 40 to secure the two elements relative to each other. Similarly, the yoke 41 may be attached to the inner storage tank 10 by means of a block 48. A pin 49 may be inserted through openings in the block 48 and through the opening 43 in the yoke 41 to secure the two elements relative to each other.

As illustrated in FIG. 1, the link 32 is in close proximity to the inner storage tank 10 and is approximately one-half the thickness of the link 34. The links 32 and 34 and the link bar 36 are preferably constructed of a unidirectional fiberglass epoxy composite material which has a high strength-to-density and strength-to-thermal conductivity ratio at cryogenic temperatures. Because the link 32 is in close proximity to the cold temperature of the inner storage tank 10, the thickness of the link 32 may be approximately one-half as thick as the link 34. The thickness of the link 32 may be decreased because the tensile strength of the unidirectional fiberglass epoxy composite material from which the link 32 is constructed increases at cryogenic temperatures. Because of this phenomenon, the tensile strength of the thinner link 32 is approximately the same as the tensile strength of the thicker link 34 because the link 32 is at a colder temperature than the link 34. Further, this reduction in thickness of the link 32 reduces the heat transfer from the outer storage tank 20 to the inner storage tank 10 by approximately one-half.

The compound strap 30 of the present invention may be readily utilized in a cryogenic storage vessel to support the inner storage tank from the inner surface of the outer storage tank. An important feature of the present invention is the fact that the link of the compound strap positioned in close proximity to the inner storage tank may be of a reduced thickness when compared to the thickness of a link positioned adjacent the inner surface of the outer storage tank. This improved compound strap of the present invention adequately supports the inner storage tank from the outer storage tank with a minimum heat leak. As may be readily understood, the heat leak from the outer storage tank to the inner storage tank is reduced because of the reduced thickness of the link positioned adjacent the inner storage tank. Further, the ultimate tensile strength and fatigue strength of the unidirectional fiberglass epoxy composite material utilized in the present invention is approximately doubled when the material is cooled to a temperature of 4 Kelvin. This increase in tensile strength and fatigue strength of the unidirectional fiberglass epoxy composite material makes it possible to reduce the thickness of the link 32 to be approximately one-half the thickness of the outer link 34.

Although the preferred embodiment of the present invention refers to two links positioned adjacent each other to support an inner storage tank from the inner surface of an outer storage tank, it should be readily understood that the strap 30 of the present invention may be constructed of a single strap which would be tapered in thickness from the outer storage tank to the inner storage tank. However, incorporating a single strap which is tapered in thickness may be difficult because of the method used in winding the unidirectional fiberglass epoxy composite material.

The compound strap of the present invention may be readily utilized in a space cryogenic storage vessel or any other cryogenic storage vessel utilized to store a liquefied gas, such as a liquefied natural gas or liquid hydrogen.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

I claim:

1. A cryogenic container comprising:

an outer shell;

an inner shell adapted to hold a liquid gas and positioned within said outer shell; and means for suspending said inner shell from said outer shell;

said means for suspending said inner shell including a compound strap comprising at least two unidirectional fiberglass epoxy links of different thicknesses, a first link of said strap having a predetermined thickness and being positioned adjacent said inner surface of said outer shell and a second link of a lesser thickness being positioned adjacent said inner shell.

2. A cryogenic container according to claim 1, wherein said second link is approximately one-half the thickness of said first link.

3. A cryogenic container according to claim 1, wherein the inner and outer ends of said first and second links are each mounted on a spool, the spool at the inner end of said first link being interconnected to the spool at the outer end of said second link with link bars.

* * * * *